US006200190B1

(12) United States Patent
Reynolds

(10) Patent No.: US 6,200,190 B1
(45) Date of Patent: Mar. 13, 2001

(54) HUGGING MECHANISM

(76) Inventor: Thomas K Reynolds, 11624 Red. Fox Dr., Maple Grove, MN (US) 55369

( * ) Notice: Subject to any disclaimer, the term of this patent is extended or adjusted under 35 U.S.C. 154(b) by 0 days.

(21) Appl. No.: 08/772,385

(22) Filed: Dec. 23, 1996

(51) Int. Cl.[7] ..... A63H 3/20
(52) U.S. Cl. ..... 446/330; 446/390; 446/376
(58) Field of Search ..... 446/320, 330, 446/352, 371, 390, 376, 379, 487

(56) References Cited

U.S. PATENT DOCUMENTS

| | | | | |
|---|---|---|---|---|
| 1,800,775 | | 4/1931 | Bostwick . | |
| 2,614,365 | | 10/1952 | Musselwhite . | |
| 2,804,721 | * | 9/1957 | Cohn | 446/381 |
| 3,053,008 | | 9/1962 | Pelumis . | |
| 3,125,828 | | 3/1964 | Ostrander . | |
| 3,448,539 | | 6/1969 | Hartpence . | |
| 3,928,933 | * | 12/1975 | Iwamoto | 446/330 |
| 4,062,144 | * | 12/1977 | Holden et al. | 446/371 |
| 4,212,132 | | 7/1980 | Lewanoni . | |
| 4,407,090 | * | 10/1983 | Pyo et al. . | |
| 4,601,671 | | 7/1986 | Demars | 446/330 |
| 4,759,737 | * | 7/1988 | Ferenczi | 446/183 |
| 4,810,227 | | 3/1989 | King | 446/354 |
| 5,378,188 | | 1/1995 | Clark | 446/330 |
| 5,470,270 | | 11/1995 | Beamon | 446/354 |
| 5,651,717 | * | 7/1997 | Hamilton et al. | 446/330 |

FOREIGN PATENT DOCUMENTS

| | | | | |
|---|---|---|---|---|
| 1009558 | * | 5/1952 | (FR) | 446/352 |
| 689145 | * | 3/1953 | (GB) | 446/330 |

* cited by examiner

*Primary Examiner*—Robert A. Hafer
*Assistant Examiner*—Jeffrey D. Carlson

(57) ABSTRACT

A mechanism adaptable for a toy provides a hugging motion to a pair of arms extending outward from each side of a rear body member. A front body member is supported by a bottom hinge in V-shaped hinged relation in front of the rear body member. Each arm is comprised of an upper arm and a relatively long forearm supported in hinged relation on the outer end of the upper arm. For each arm, a wide, elongated, yielding forearm actuator is hingedly attached on its outer end to the forearm and on its inner end to the front body member. A hand is hingedly supported on the outward end of the forearm. Supported in front of the forearm is an elongated, yielding hand actuator adapted to move the hand when the forearm actuator is moved toward the forearm. Squeezing the body portions together causes the forearm actuators to pivot the forearms forward in a hugging motion.

30 Claims, 4 Drawing Sheets

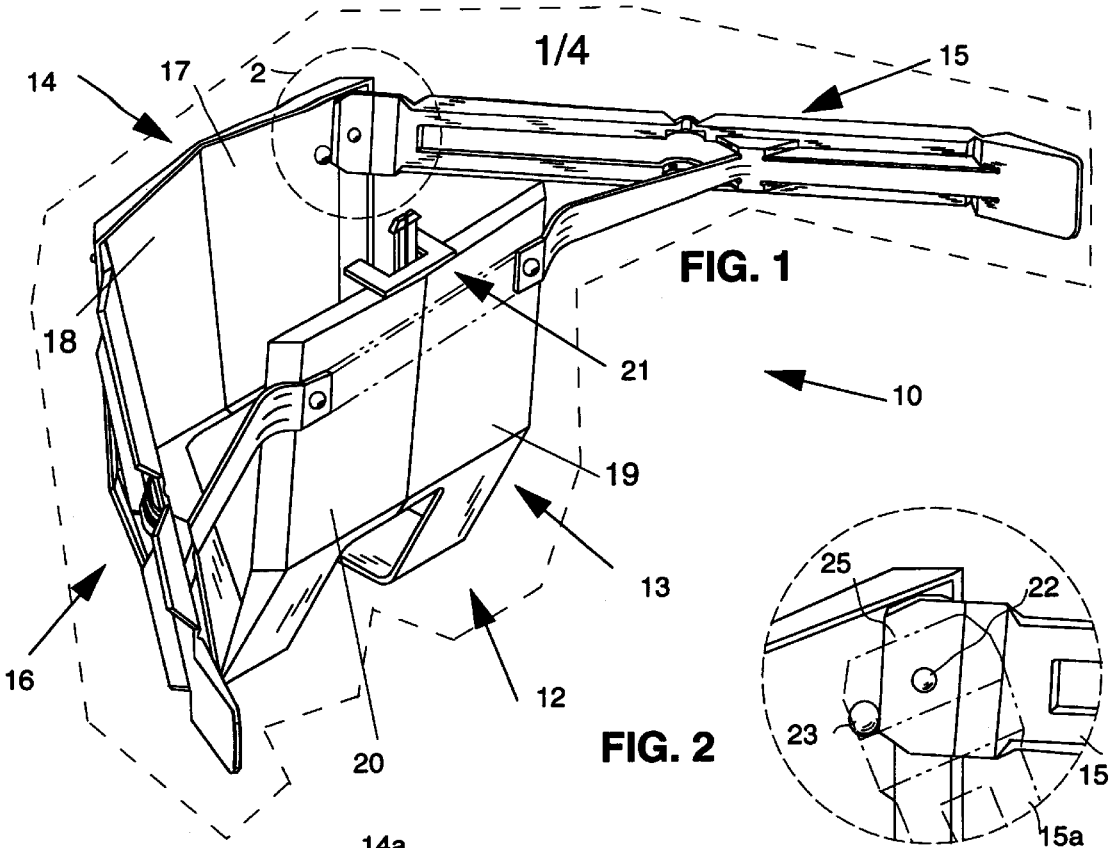
FIG. 1
FIG. 2
FIG. 3
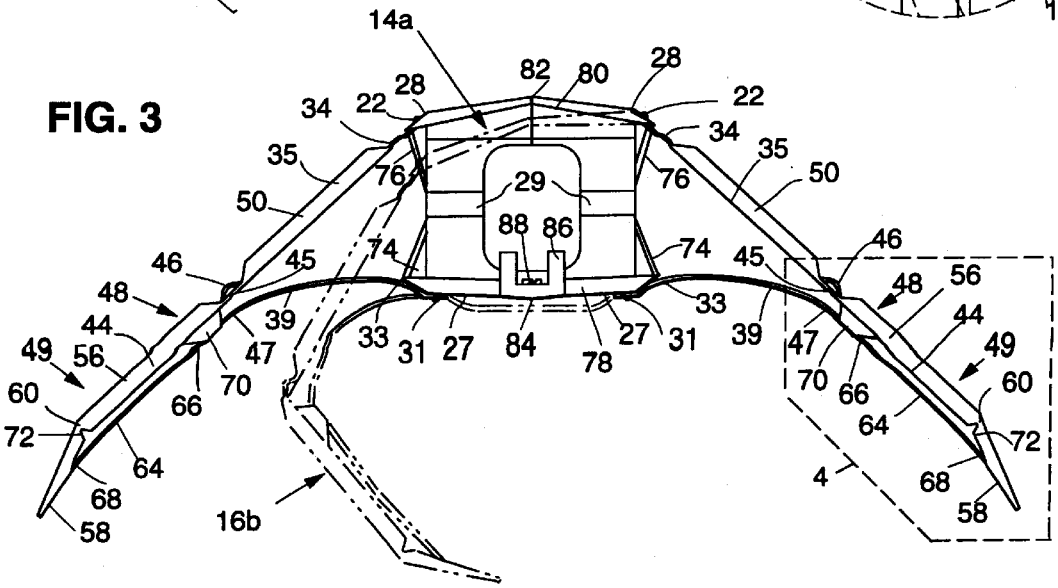

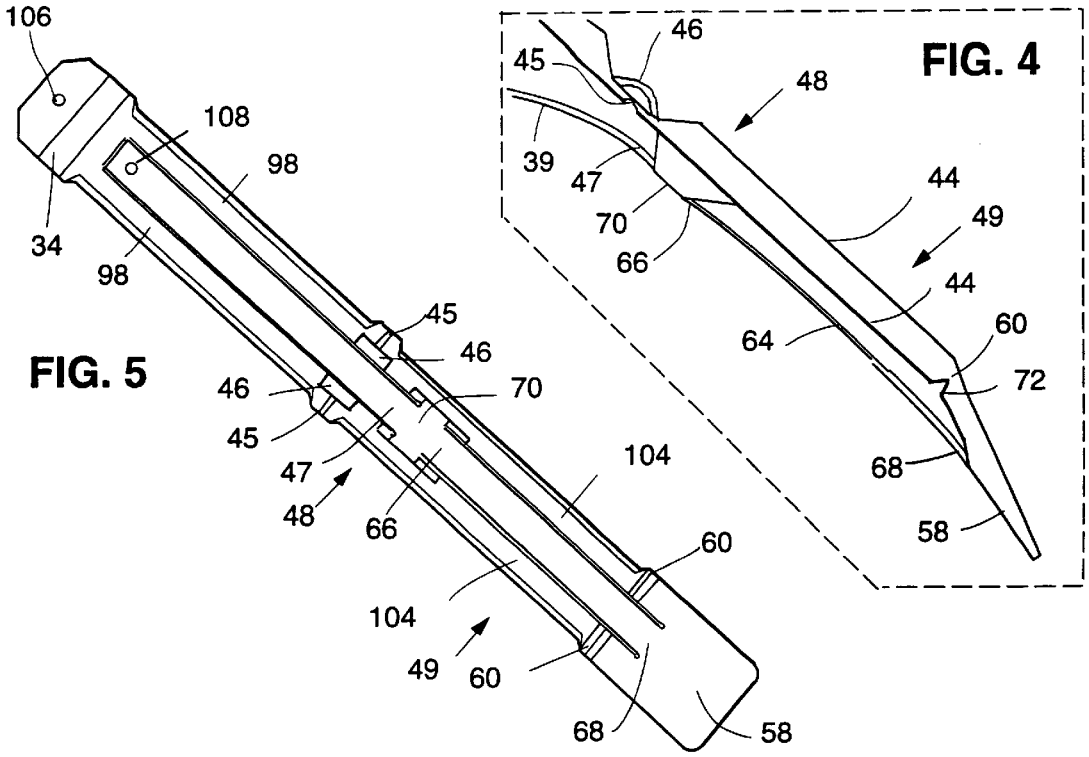
FIG. 4
FIG. 5
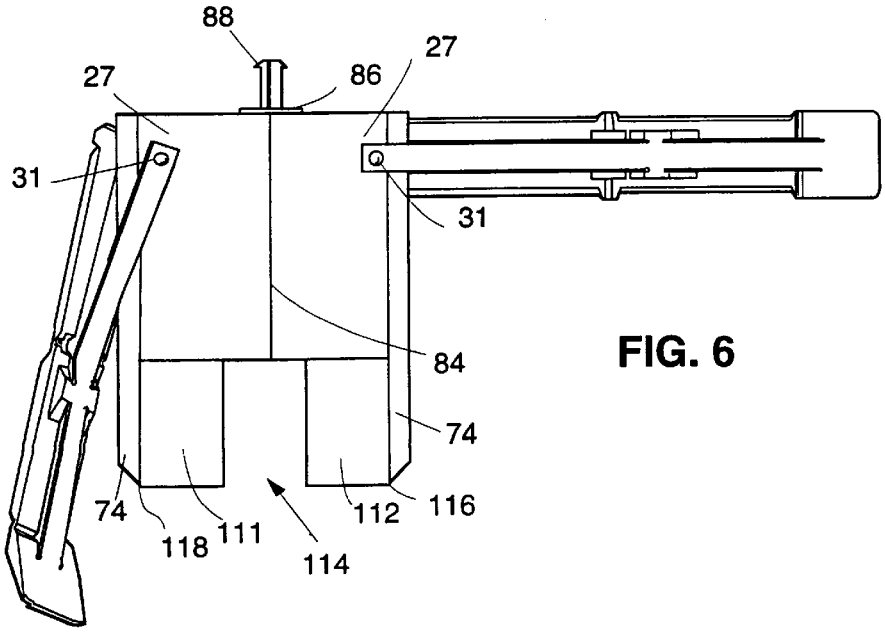
FIG. 6

HUGGING MECHANISM

BACKGROUND OF THE INVENTION

1. Field of the Invention

The present invention relates to a mechanism for moving mechanical arms and more particularly to moving two arms in a hugging motion.

2. Description of the Prior Art

Hugging mechanisms are known in the prior art and have been devised with a variety of configurations for the purpose of providing mechanical hugging or squeezing on a human or object. These mechanisms have been adapted to be used with toys including androids having a pair of arms and hugging an object located between the arms and body of the mechanism. Prior art patents show many hugging mechanisms for dolls and toy animals; however, these mechanisms do not hug as a human would. Although "Huggable" is one of the most common advertising descriptions for toys such as a Teddy bear, toys having a hugging feature have not been widely popular in the United States.

For example, the prior art discloses in U.S. Pat. No. 1,800,775 a figure toy having a body hingedly supporting a pair of single member arms linked to the toy's legs. The arms pivot horizontally forward only at the shoulders when the legs are squeezed together. The use of legs for actuating the arm members, limits the toy's hugging capability.

U.S. Pat. No. 2,614,365 discloses a doll with movable arms that hinge only about the shoulder. Resilient body members support, in spaced relation, articulated arms that house yielding curved metal strip members which extend from the front of the body into the arms. Pushing in and releasing the rear of the body causes the arms to pivot only horizontally forward.

U.S. Pat. No. 3,053,008 discloses a hugging doll having front and rear body members hinged at the bottom. When pressed inward, the front body member, which is in sliding, unattached contact with a yielding curved metal strip, pivots the strip ends and the arms they support horizontally forward. For the latter two mechanisms, the hugging pressure of their arms is limited by the yielding requirements of the strip material.

U.S. Pat. No. 3,125,828 discloses an animated doll. A body supports single member arms and legs hinged to move horizontally forward in a single axis only at the shoulders and thighs. Pushing inward on a vertically pivoted chest member, hinged at the body bottom, causes sliding, unattached contact of inward ends of wire members inside the body to pivot rearward and cause the outward ends of these wire members with attached arms and legs to rotate forward.

U.S. Pat. No. 4,212,132 discloses a doll having embracing movement with single member arms. A front body member, when pushed inward, causes the short legs of L-shaped arm members to pivot rearward and the long legs of these same L-shaped arm members to pivot horizontally forward at the shoulders.

U.S. Pat. No. 4,601,671 discloses a huggable toy mechanism with rearward bent arms hingedly attached midway up each side of a front plate. Short linkages are hingedly attached behind each arm and midway up each side of a parallel rear plate. When the plates are squeezed together, the stiff arms pivot horizontally forward at the shoulders. Hinge binding is possible if pressure is applied above or below the arms.

U.S. Pat. No. 5,470,270 discloses a doll with baby hugging capabilities having a rear plate supporting single member, L-shaped arms which pivot horizontally at the shoulders. When a chest member pushes rearward the short end of the L, the stiff arms rotate forward on the long end of the L.

In the following two patents, dolls with multi-segmented arms with cables attached to a short outer arm portion of the outermost arm segment, extend through front openings on each arm segment, and are attached to a body member. When the cables move inward, each appendage pivots forward, only horizontally, about rear hinges between segments. Inward movement of the cable reduces the reach of the arms. The multi-segmented arms do not bend or hug like human arms but contact the person hugged only at the end of outer segment which is like hugging with only the finger tips touching. In U.S. Pat. No. 4,810,227, the cables are pulled inward by a motor. In U.S. Pat. No. 5,378,188, opposed leaf springs bow apart to pull inward the opposite cable and attached arm. Without moving the whole doll body, these mechanisms disclose little or no ability for each arm to pivot to a different angle to provide good hug on a person not centered on the mechanism.

The above prior art disclose two types of arm actuating mechanisms for pivoting arms horizontally at the shoulder. First type mechanisms have single segment arms and hug when two spaced body members are squeezed together. Second type mechanisms have arms with multiple, relatively short segments which hug when a front cable extending to the outermost rear linked segment pulls the arm segment inward, possibly like an octopus.

The above patents show arm members which do not act as a human arm and neither pivot forward at an elbow nor provide a human-like hug.

The above prior art mechanisms are generally designed for normal sized dolls which have insufficient arm reach to effect an encompassing hug on many children. Their small arms often push outward rather than pull inward the person being hugged by the mechanism.

These mechanisms have constructions which are not robust or have small pressure surfaces which actuate their arms or have arms which contact only a small area of a person being hugged.

The above patents disclose no substantial capability for vertical arm movement about a shoulder to allow the doll's arms to avoid the user's arms.

These prior art dolls with their arms always extended horizontally look less human than dolls with the ability to pose with their arms down.

It can be concluded that a toy that provides a user with a more human-like hug has been a long needed, substantially unrecognized, and unreached goal for the consumer until the present invention. To eliminate the above problems and fulfill the need for a new and improved hugging mechanism, the present invention substantially departs from the conventional concepts and designs of the prior art and provides a hugging mechanism which applies the necessary arm motion, pressure, and comfort so that a person feels better after receiving its hug.

SUMMARY OF THE INVENTION

In comparison with the hugging mechanisms disclosed in the above prior art, the hugging mechanism of the present invention provides for a lower cost, more life-like toy with a body which is easier to be squeezed and arms which provide improved hugging or embracing capabilities. The hugging mechanism of the present invention comprises a body and a pair of arms supported outwardly therefrom. The body comprises a front body portion and a rear body portion each having large, easily accessible pressure surfaces which are hinged together in V-shaped relation at a bottom hinge. Each arm is comprised of an upper arm attached to the rear body portion and a relatively long forearm hingedly attached to the outer end of the upper arm by an elbow hinge. A forearm actuator supported by the front body portion and hingedly attached to the forearm. Optionally, a hand is hingedly attached to the outward end of the forearm and a yielding hand actuator extends from the front forearm to the hand.

When a person holds the mechanism against his chest and hugs it, the rear body portion moves toward the front body portion. Then the arms pivot horizontally and/or vertically at shoulder when the upper arm pushes the forearm actuator and the forearm forward. Upon contact of the forearm actuator with the person, further forward movement of the upper arm causes the forearm to rotate forward at the elbow hinge until the forearm contacts the person. Further forward movement of the forearm causes the hand actuator to pivot the hand forward.

This hugging mechanism provides relatively long, resilient arms which are able to reach behind the user to apply hand pressure on the backside of their body. The arms not only provide an improved hugging motion, but also provide greater arm force, greater reach, and more evenly distributed arm pressure as well as ability to better adjust to the location of a user's arms and body. Also, the present invention provides a hugging mechanism for incorporation with a toy including an android, doll, stuffed animal, or human-like object.

If the hugging person is not symmetrically aligned with the mechanism, the front and rear body portions move sideways or twist relative to each other to allow the arms to simultaneously reach the different distances to the person while maintaining contact with the person's chest. If contact with the hugging person moves the arm vertically, the mechanism will pivot and hug in a vertical direction. If the mechanism's arms start in a down position, upon being hugged the arms will pop upward and then move in a hugging motion. Sufficient force applied to the rearward curved rear body portion, bends its center inward and pushes the arms laterally outward to further increase the arms' reach.

Thus has been outlined some of the more important features of the invention in order that the detailed description that follows may be better understood and the improvements in the art may be appreciated. There are additional features of the invention that will be subsequently described and which are included in the subject matter of the claims.

In this respect it is to be understood that the invention is not limited in its application to the details of the construction and to the arrangement of the components set forth in the following description or illustrated in the drawings. The invention is capable of other embodiments and of being practiced and carried out in a various ways. Also, it is to be understood that the phraseology and terminology employed herein are for the purpose of descriptions and should not be regarded as limiting.

Also, the abstract of this invention is neither intended to define the device of this application nor is it intended to limit its scope in any way.

Those skilled in the art will appreciate that the conception upon which this disclosure is based may readily be utilized as a basis for the design of other structures, methods, and systems for carrying out the several purposes of the present invention. It is important that the claims be regarded as including such equivalent constructions insofar as they do not depart from the scope or spirit of the present invention.

It is therefore an object of the present invention to provide a mechanism with its arms able to produce a hugging action on a user or object.

It is a second object of the present invention to provide a hugging mechanism which has the advantages of the prior art mechanisms and without the substantial disadvantages.

A third object of the invention is to provide a hugging mechanism, having few parts and made of inexpensive materials, such that it can be easily and inexpensively manufactured and be economically feasible for the public to buy.

A forth object of the invention is to provide a hugging mechanism which is durable by making it with materials which can be repeatedly flexed and which is reliable by having securely attached parts which can bend or twist in multiple axes.

A fifth object of the present invention is to provide a hugging mechanism capable of adapting to and providing a comfortable hug for many different sizes of people by having large area, conforming body contacting members, and arms bendable at the elbow and wrist.

A sixth object of the present invention is to provide a mechanism having arms which can provide significant hugging pressure at different distances simultaneously for multiple or off-centered objects.

A seventh object of the present invention is to provide a hugging mechanism which is capable of moving its arms and hugging in both the vertical and horizontal directions and to adjust to the person or object being hugged and, if necessary, avoid their arms.

An eighth object of the present invention is to provide a hugging mechanism with a relative long arm reach to put pressure on the back side of a user's body.

A ninth object of the present invention is to provide a mechanism having arms with the appearance of a substantially normal length and the ability to extend further outward while hugging.

A tenth object of the present invention is to provide a hugging mechanism which first will move the upper arms forward, and second will move the forearms and hands inward—much like a real human would do to assure contact of the sides of the arms.

An eleventh object of the invention is to provide a toy with a hugging mechanism having arms moveable vertically which can be packaged in a relatively small container, stored in a small volume, and displayed with little shelf space to reduce costs.

A twelfth object of the invention is to provide a toy with an improved appearance by having the capability of hugging with human-like upper arm, forearm, and, if available, hand proportions.

A thirteenth object is to provide a hugging mechanism able to hug in the vertical as well as the horizontal direction.

A fourteenth object is to provide a hugging mechanism having relatively large pressure surfaces adapted for user comfort and good arm leverage to provide great enough squeezing pressure such that the human-like hug it delivers really matters.

A fifteenth object is to provide a hugging mechanism having the ability to have its arms in both a horizontal position for hugging and a downward position for a more human-like pose.

A sixteenth object is to provide a hugging mechanism having the ability, when squeezed, to pop up its arms to a horizontal position, and thus appear to come alive and be ready to hug.

A seventeenth object is to provide a hugging mechanism difficult to damage by having a construction which allows the arms to be bent in many directions including backward at the elbow.

The preceding objects, listed in no particular order, together with various features of novelty which characterize the invention, are pointed out with particularity in the description and claims which form a part of this disclosure. For a better understanding of the invention, reference should be made to the accompanying drawings and descriptive matter in which there are illustrated preferred embodiments of the invention.

BRIEF DESCRIPTION OF THE DRAWINGS

The invention will be better understood and objects other than those set forth will become apparent when consideration is given to the following detailed description. Such description makes reference to the annexed drawings wherein:

FIG. 1 is a perspective view of the preferred embodiment of the hugging mechanism constructed in accordance with the principles of the present invention.

FIG. 2 is a partial perspective view of FIG. 1 showing an enlargement of the shoulder area showing the left arm in alternate vertical positions.

FIG. 3 is a top plan view of the mechanism showing the right arm in alternate horizontal positions.

FIG. 4 is a partial top plan view of the left arm of the mechanism.

FIG. 5 is a side elevational view of the left arm of the mechanism separated from the body.

FIG. 6 is a front elevational view of the mechanism.

The same reference numerals refer to the same parts through the various figures.

DESCRIPTION OF THE PREFERRED EMBODIMENT

Figure 7A:
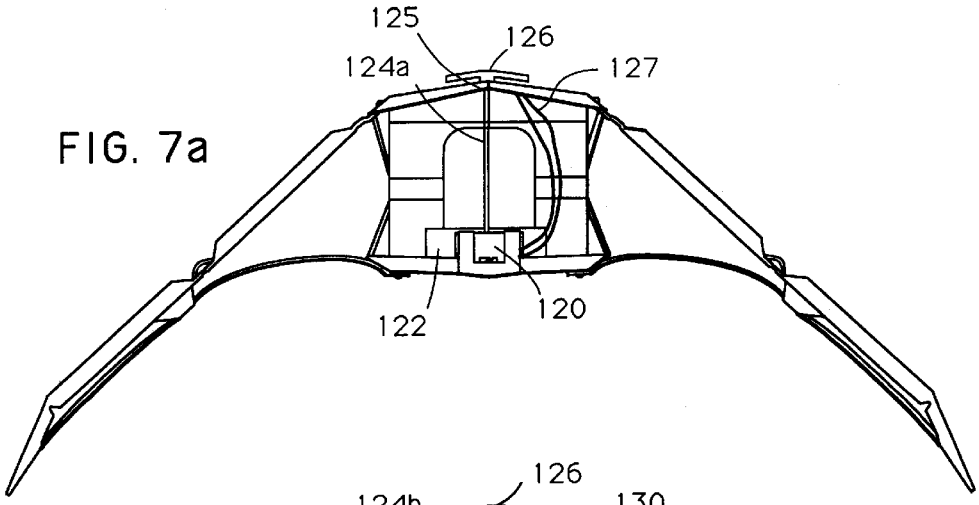
FIG. 7*a* is a view similar to FIG. 3 showing an alternative mechanism with a motor and a connection means in a first cable routing configuration.

With reference to the drawings and in particular to FIG. 1, the preferred embodiment, a hugging mechanism 10, generally designated by its reference numeral, embodies the principles and concepts of the present invention. The central component of the hugging mechanism is a center member or body 12 comprising a front body member or a front body portion 13 and a rear body member or a rear body portion 14 supporting a left arm 15 and a right arm 16 extending outwardly therefrom. The rear body portion includes a left rear member or left rear portion 17 and a right rear member or right rear portion 18 which extend upward from the center bend of the rear body portion and, in combination, comprise a rear pressure surface. The front body portion includes a left front member or left front portion 19 and right front member or right front portion 20 which, in combination, provide a front pressure surface.

The left arm and right arm are supported in articulated relation to the body by hinges and pivots. A neck 21 is fastened on the front body portion from which it extends upward a distance. Such components are individually configured and correlated with respect to each other so as to attain the desired objective.

Referring to FIG. 2, a partial perspective view of left arm 15 is shown in a horizontal position. In an alternate position, the left arm 15*a* is shown rotated about an upper arm pivot pin 22 to an alternate downward position. The left arm has moved over an optional vertical arm support 23 position which protrudes inwardly from the rear body portion to provide additional vertical support. The left and right arms are each comprised of an arm support spring 25 which contacts the rear body portion at an angle and supports the arm in a horizontal position. Additional vertical supports may be added to allow for several vertical arm positions.

Referring to FIG. 3 and FIG. 4, wherein the top view of the mechanism shows with an alternate position right arm 16*b* pivoted forward and inward in a hugging position. On the front body portion at each top corner is a front arm support 27 for each arm and the rear body portion comprises a rear arm support 28 for each arm. A pivotable, twistable body hinge or bottom hinge 29 which includes an integral bottom hinge spring hingedly attaches together the front and rear body portions a distance apart at the bottom of the body.

Each arm is connected to the body and adapted to move in the vertical direction by the combination of a forearm actuator pivot pin 31 supported on the front arm support and an upper arm pivot pin 22 supported on the rear arm support. Each arm is adapted to move in the horizontal direction by an inner actuator hinge or a forearm actuator hinge 33 on the inner end of the forearm actuator and, optionally, an inner arm hinge or an upper arm hinge 34 which acts as a horizontal arm pivot or hinge on the inner end of the upper arm.

The right and left arm are each comprised of a rigid, relatively long, forward angled inner arm member, upper arm member, or upper arm 35 pivotally attached on the rear body portion on an upper arm pivot pin 22 which acts as a vertical arm pivot or hinge.

A wide and yielding outer arm actuator, arm actuator or forearm actuator 39 is hingedly supported at its inner end by the front body portion and acts as a horizontal arm pivot or hinge. The forearm actuator is pivotally attached a forearm actuator pivot pin 31 which acts as a vertical arm pivot or hinge. A rigid, relatively long outer arm member, forearm member, or forearm 44 is supported on an outer arm hinge or elbow hinge 45 having two spaced portions and which includes a pair of integral elbow hinge springs 46. An outer actuator hinge or forearm hinge 47, which includes an integral forearm hinge spring, is hingedly attached to the front side of the forearm at an offset distance outward from the elbow hinge and to the outer actuator end. Either individually or in combination, the forearm actuator, the forearm hinge spring, and the elbow spring comprise an arm control means having a resistance member to bias the forearm generally outward. The forearm is comprised of an inner forearm portion or inner arm portion 48 between the forearm hinge and the elbow hinge and an outer forearm portion or outer arm portion 49 extending outward to the end of the arm. A pair of resilient upper arm horizontal stiffeners or horizontal arm portions 50 extend outward on each side of the upper arm to provide upper arm stiffness.

The forearm actuator is supported on its inner end at front arm support by the forearm actuator hinge and on its outer end at the forearm by the forearm hinge. A pair of resilient forearm horizontal stiffeners 56 extend outward from the forearm to provide forearm stiffness.

A hand member, or hand 58 is hingedly attached to the end of the forearm by a hand or wrist hinge 60, on the outward end of the forearm. An tip member actuator or hand actuator 64 is supported on its inner end by a hand actuator hinge 66 and on its outer end by a hand hinge 68. The hand actuator hinge is supported a distance inward from the forearm and is attached on a forearm inner support 70. A hand actuator stop 72 is supported on the hand between the hand and the forearm. The hand hinge, hand actuator hinge, and the wrist hinge are made of elastically deforming material and have integral springs which co-act to bias the hand outward and the hand actuator forward. In the preferred embodiment each entire arm including the hand, forearm actuator, hand actuator, upper arm, forearm, and the connecting hinges are formed into a single piece.

Referring to the body area, a pair of resilient front side stiffeners 74 on the front body portion and a pair of resilient rear side stiffeners 76 on the rear body portion extend outwardly and towards the center of the body from each vertical side to reduce the edge pressure of a person hugging the front or rear body portions. A resilient front top stiffener 78 and a rear top stiffener 80 extend inward, respectively, from the front body portion and rear body portion and are adapted to deflect a limited distance on, respectively, a rear center hinge 82 and a front center hinge 84. The rear top stiffener limits the upward vertical movement of the arm.

The neck is supported on the front body portion and is comprised of a yielding neck head support 86 which extends horizontally inward and from which a neck head attachment 88 extends upward. The neck provides an attaching means and a platform for supporting a head (not shown) of a toy.

Referring to FIG. 5 wherein a side view of the left arm detached from the body shows a pair of resilient upper arm vertical stiffeners or vertical arm portions 98 a spaced distance apart on each side of the forearm actuator supporting the horizontal stiffeners in substantially orthogonal relation on each side of the upper arm. An elbow hinge 45 and an elbow hinge spring 46 are each comprised of two hinged portions positioned on either side of the forearm which allow a single piece arm including a forearm, forearm actuator, and upper arm. The spacing of the vertical arm portions allows both the forearm actuator and upper arm to be formed at substantially the same time by a simple molding tool without a moveable tool section between the forearm actuator and the upper arm. A resilient forearm inner support 70 holds apart at a spaced distance a pair of resilient forearm vertical stiffeners or forearm vertical portions 104 which support the forearm horizontal stiffeners in orthogonal relation on each side of the forearm.

An upper arm pivot 106 and a forearm actuator pivot 108 provide the bearing surfaces for upper arm pivot pins and the forearm actuator pivot pins for, respectively, the upper arm and the forearm actuator.

Referring to FIG. 6 wherein a front view shows the hugging mechanism with one arm in a horizontal position and one arm in a vertically down position. A left hinge support 111 is spaced from a right hinge support 112 to provide a separation for a bottom hinge opening 114 which extends a distance up the front and rear body portions to allow a left bottom hinge 116 and a right bottom hinge 118 to extend into the legs of a toy, if desired.

Referring to FIGS. 7*a* through 7*f* wherein the elements of FIG. 3 further include an arm motive means including a motor means 120 powered with energy from an optional battery or power source 122. In views FIGS. 7*a* through 7*f* cables are designated by 124*a* through 124*f*, respectively, to show that their lengths are likely to be different. In FIGS. 7*a* through 7*f*, a motor actuating means such as a movement sensor, movement switch, pressure sensor, or pressure switch 126 is electrically connected to the motor means by an electrical connection means or electrical wires 127 which are shown when the motor means is separated a substantial distance from the pressure switch. The pressure switch is adapted to sense the pressure and turn on the motor means and pull the cable inward toward the motor means. The motor means includes, as necessary, a transmission means adapted provide the motor means with the capability of actuating the arms in a hugging motion which includes gearing, pulleys, and other members needed to pull the cable toward the motor means, a force balancing means adapted to balance the forces for the different arms and allow continued movement of moveable arm when one arm is prevented from moving, and a motor return means adapted to allow the cables, arm members, and arm support members to return to predetermined positions after hugging. FIGS. 7*a* through 7*f* show different routings for a resilient cable or connector between the motor means and a arm member or arm support member. For each arm, as necessary, a cable is routed through and moves past supports such an opening, a pulley or the like. The cable routing of different species may be combined as necessary or extend to a more outward arm member than shown. FIGS. 7*a* through 7*f* show different locations of the motor activating means, power source, motor means, cable guides, cable supports which are intended to show some of the arrangement possibilities of the power mechanism but are not intended to limit their scope.

Referring to FIG. 7*a*, wherein a resilient cable or connector 124*a* is supported between motor means 120 and the middle of the rear body portion by a cable support 125. Optionally, the cable can be connected to one or more arm supports.

Figure 7B:
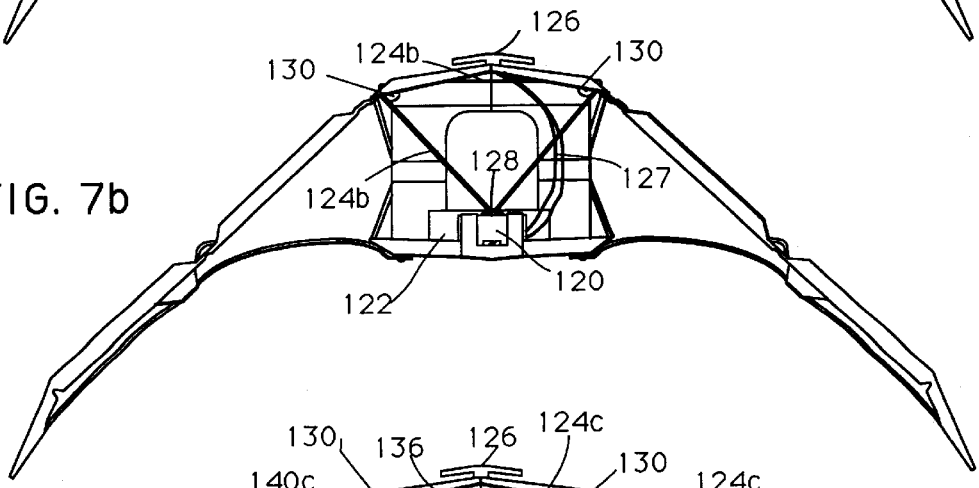
FIG. 7*b* is a view similar to FIG. 3 showing an alternative mechanism with a motor and a connection means in a second cable routing configuration.

Referring to FIG. 7*b*, wherein a cable 124*b* extends from the motor means 120, through a motor cable guide 128, then through an outer rear guide 130, extends across the inside of the rear body portion then passes through to the opposite side outer rear guide and back to the motor means. Connecting the cable between the rear cable guides allows the hugging mechanism to balance arm forces for off-center hugging.

Figure 7C:
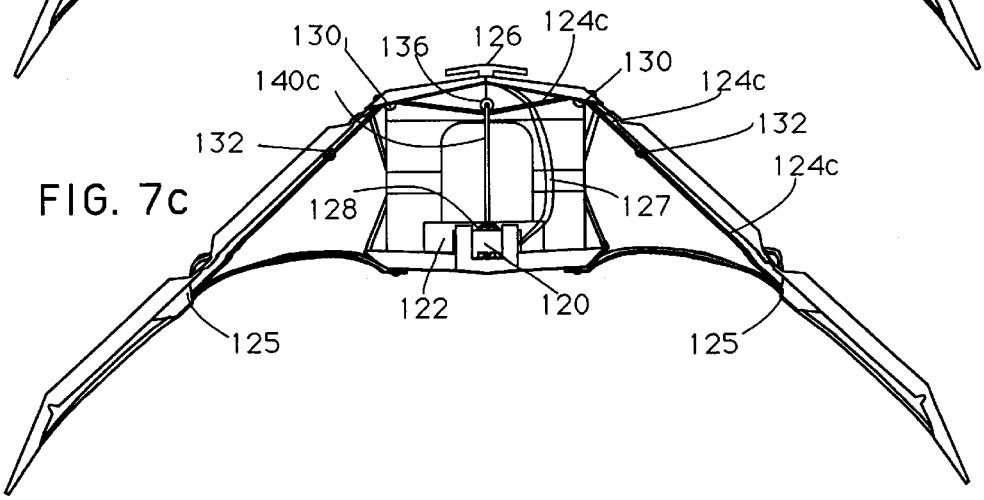
FIG. 7*c* is a view similar to FIG. 3 showing an alternative mechanism with a motor and a connection means in a third cable routing configuration.

Referring to FIG. 7*c* wherein a cable 124*c* is supported at cable support 125 a distance from the elbow hinge on the forearm and extends through an arm guide 132, through the outer rear guide 130, through a center balance guide 136 through the opposite side rear guide 130, and through opposite arm guide 132 to cable support 125 on the opposite forearm where it is supported a distance from the elbow hinge. The motor means pulls inward a center balance guide 136 with a center cable 140*c* which pulls cable 124*c* and causes the rear body the move toward the front body portion and the mechanism to hug. Cable 124*c* moves through the center balance guide to allow hugging with different movement of each arm.

Figure 7D:
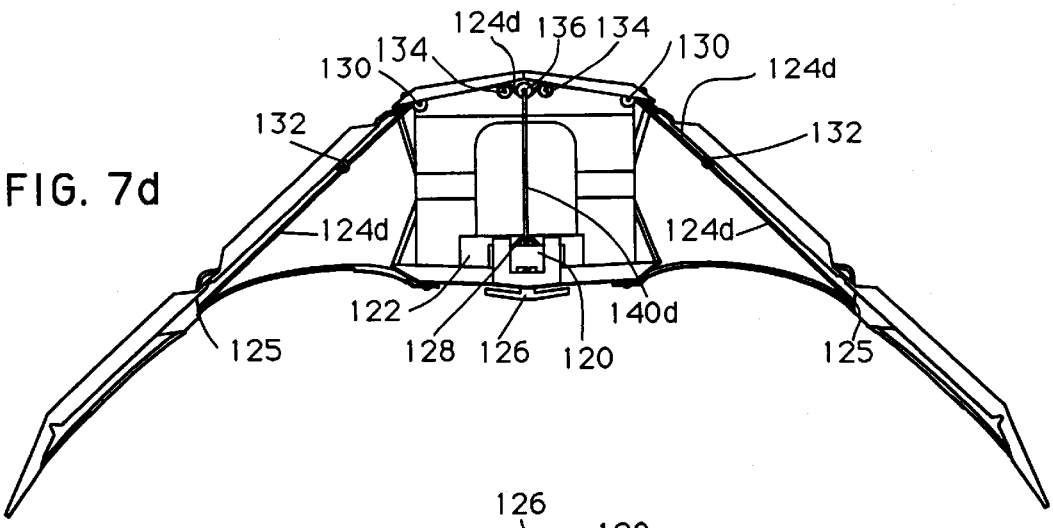
FIG. 7*d* is a view similar to FIG. 3 showing an alternative mechanism with a motor and a connection means in a fourth cable routing configuration.

Referring to FIG. 7*d* wherein a cable 124*d* is supported on one forearm at cable support 125 and extends through arm guide 132, through outer rear guide 130, through an inner rear guide 134, through center balance guide 136, through the opposite side by going through opposite inner rear guide 134, through opposite outer rear guide 130, through opposite arm guide 132 and is supported by opposite cable support 125 at the opposite forearm. A center cable 140*d* is supported on one end at center balance guide 136 and extends through motor cable guide 128 to motor means 120. Cable 124*d* extends through center balance guide 136 which is outward of inner rear guides 134 so that when the motor means pulls inward center balance 136 cable 140*d* pulls inward the rear body portion and moves the arm in a hugging motion.

Figure 7E:
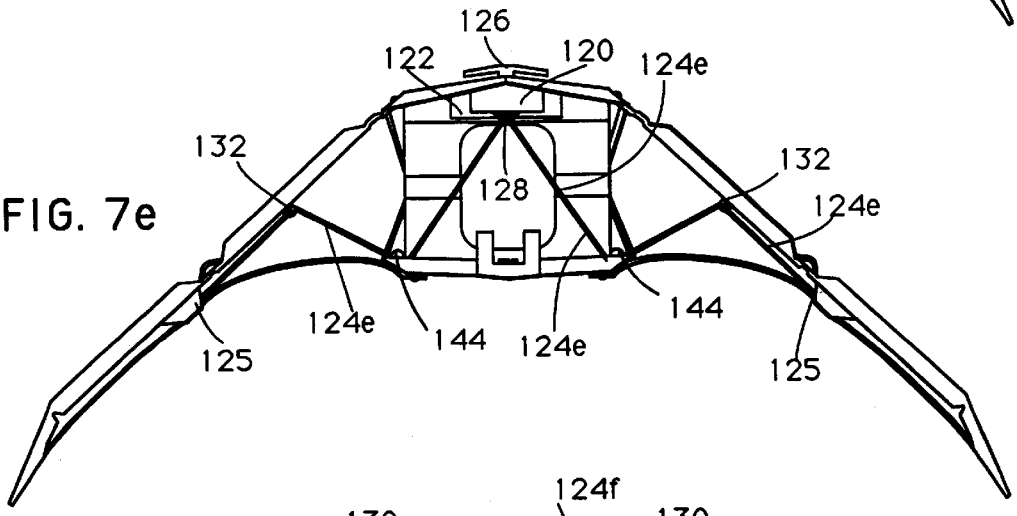
FIG. 7*e* is a view similar to FIG. 3 showing an alternative mechanism with a motor and a connection means in a fifth cable routing configuration.

Referring to FIG. 7*e* wherein, for each arm, a cable 124*e* is supported at each forearm at cable support 125 a distance from the elbow hinge and extends through arm guide 132, through a front cable guide 144, through motor cable guide 128, to motor means 120. The motor means includes a means for balancing the cable force between the forearms.

Figure 7F:
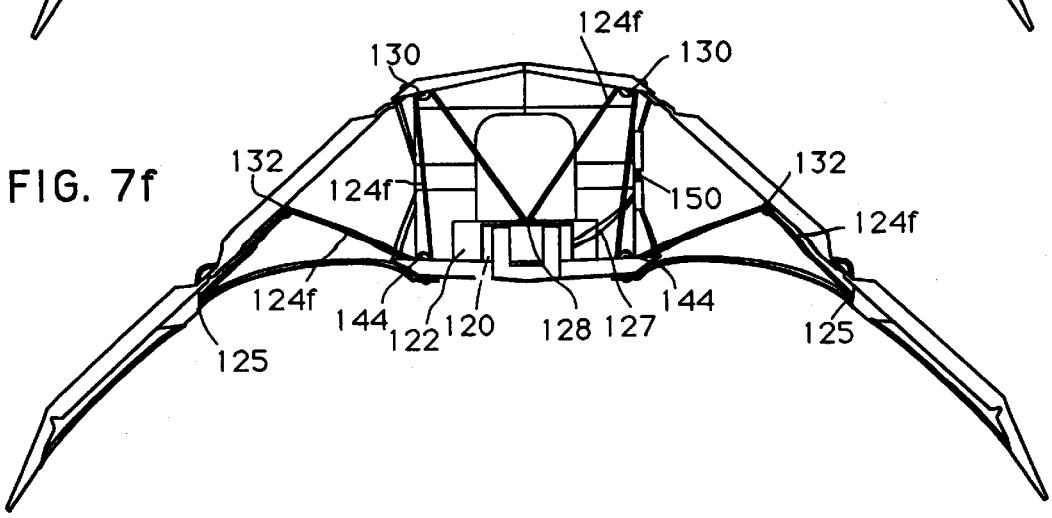
FIG. 7*f* is a view similar to FIG. 3 showing an alternative mechanism with a motor and a connection means in a sixth cable routing configuration.

Referring to FIG. 7*f* wherein, for each arm, a cable 124*f* extends from cable support 125 on the forearm, through front body guide 144 on the front body portion, through arm guide 132, through outer rear guide 130, through motor cable guide 128, to motor means 120 supported on the front body portion. Squeezing or moving together the front and rear body portions activates a motion switch 150 which activates the motor means 120 to pull inward cable 124*f* and pull together the front and rear body portions while keeping each upper arm from moving rearward and pivoting each forearm forward.

OPERATION

General

For directional orientation in describing this invention, the arms are angled toward the front side of mechanism and the opposite side is the rear. The lateral direction is generally perpendicular to the front direction. The neck is up or top and the body hinge is down or bottom. The space between the center of the front and rear body portions is considered the center of the mechanism. Movements generally toward the center are inward and the opposite direction outward. The horizontal plane and axis is shown in the top or plan view and the vertical plane and axis is shown in the front view.

The arm actuation means comprises any features which are adapted to actuate the arms in a hugging motion including the body portions and forearm actuator which serve to be squeezed on and move the forearm and arm.

The arm articulation means includes any features which are adapted to allow the arms to be positioned including the arm supports and arm pivots, the front and rear body portions, center hinge, forearm actuator hinge, upper arm hinge and bottom hinge.

The body articulation means includes any features which are adapted to allow the arm supports to be positioned including the bottom hinge, center hinge and front and rear body portions.

Hinges

The hinges in this patent are broadly described as a means to support members in articulated relation including hinged, pivotal, and jointed relation. Any of these hinge definitions may allow either attached or unattached relative movement of two or more members in one or more axes. Certain portions of the mechanism are described as hinges because the mechanism usually bends at the designated location and usually the material is thinner than the surrounding areas. In the present invention, hinges are comprised of flexible plastic material; however, hinges may be constructed of pivot pins, rivets, bolts, fabric, flexible foam, ball joints, universal joints, or a spatial relationship controlling means. The plastic material elastically deforms to allow body or arm members to change orientation with respect to each other.

An integral hinge connects, in articulated relation, two or more portions of the single piece part. For a one piece arm to reduce costs, the forearm hinge, elbow hinge, wrist hinge, forearm actuator hinge, hand actuator hinge, and upper arms hinges are integral hinges. The integral hinge is properly formed in a variety of designs, such as a thin, very flexible "living" hinge, and made of a suitable material, such as polypropylene, having the ability to withstand repeated flexing.

A hinge of sufficient thickness may include a spring function which because of its thickness, or other design features allow the hinge to act as a spring member or a return spring. The integral spring works because hinge material has sufficient residual stress after being deformed elastically to return the attached parts to their original positions after the parts are allowed to pivot. A spring with a bias means it has a tendency to cause an attached member to return to or stay at a predetermined orientation. Some or all of the hinges of the mechanism including the bottom hinge, forearm actuator hinge, forearm hinge, elbow hinge, and upper arm hinges may include integral springs or other such reset means capable of biasing outward the body portions, arms, and hands after the hugging mechanism is squeezed and released. The hinges of this invention have different spring strengths for various purposes to allow the mechanism to operate correctly and depend in part on specific design and dimensions.

The arms of the present invention are hinged at the shoulder with separate hinge portions for horizontal and vertical movement; however, by using a two axis hinge such as a ball and socket joint, a cable, or the like, both the horizontal and vertical movement can be combined in a single action. For horizontal movement of each arm, the shoulder hinge is comprised of the forearm actuator hinge supported on the front arm support and, optionally, an upper arm hinge supported on the upper arm near the rear arm support. The upper arm hinge has greater resistance to movement than the forearm actuator hinge; consequently, when the rear arm support is moved forward, the resilient, forward supported upper arm moves forward and; therefore, the whole arm moves forward. The upper arm hinge allows arm flexing and provides part of the outward spring tension to position the arms outwardly and for the mechanism to easily accept a user positioned between the arms. Alternatively, a sufficiently resilient forearm actuator can be used to bias outward the body portions and reset the mechanism to its original position.

Body

The body is comprised of a front body portion and a rear body portion which are spaced apart at the top and are hingedly attached together at their bottom ends by an integral bottom hinge. Each body portion comprises two arm supports located at each upper side, a slightly concave, relatively large pressure surface at its top, and a lower portion having bottom hinge supports which extend inward to a bottom hinge. A bottom hinge spring is incorporated into the bottom hinge and biases apart the front and rear body portions in V-shaped relation to provide sturdy construction for reliable hinge movement. The space at the top between the front and rear body portions provides the actuation distance needed for leverage to cause the arms to move in a hugging action.

The bottom hinge includes a horizontal portion which separates the front and rear body portions a distance to reduce inward angle of the hinge supports and aids twisting of the front and rear body portions for asymmetrical hugging. The somewhat parallel relation of the front and rear pressure surfaces reduces the tendency of the mechanism or associated doll to slip in an upward direction when hugged. For picking up an object or moving arms inward or for hugging, the arms of the present invention can be squeezed together between two hands or, if made small enough, be squeezed together with the fingers of one hand.

To provide a mechanism which hugs with force, the front and rear pressure surfaces are usually made large. Also, the spaced apart, inwardly bent bottom hinge supports allow a relatively long bottom hinge to fit into the legs of small toys for increased leverage to allow a squeezing force applied below the arm supports to result in an increased hugging force applied by the arms to the user.

In the preferred embodiment, a neck supports the head (not shown) and is attached to the front or, optionally, the rear body portion. To horizontally and vertically support an attached head (not shown) away from a body portion, the neck extends inward then upward. Unlike a doll with stuffing inside, fabric skin is not normally used to support a doll head because, when the body is squeezed, the skin becomes too flexible.

Arms

In one manner, the hugging mechanism hugs because its front members comprising, as needed, the front body portion and the forearm actuators which have combined pivotal or effective lengths shorter than combined pivotal or effective lengths of the rear members or portions thereof they are in front of. These rear body members comprise, as needed, the rear body portion, upper arms, and inner forearm portions. The arm actuating means comprises in one case the front member or portions thereof which move rearward toward the rear members which causes the arms to pivot forward in a horizontal hugging motion to compensate for the longer rear members. In another case, the arm actuating means comprises rear members or portions thereof which support the arms and move toward the shorter front members or portions thereof to cause the arms to hug. In both cases the arm actuating means moves toward the arm support means.

In the preferred embodiment, the distance from the forearm hinge to the rear arm support, which includes the inner forearm portion and the upper arm, is longer than the distance from the forearm hinge to the forearm actuator hinge which is substantially the length of the forearm actuator. Alternately, the forearm actuator can be supported at different locations a lateral distance inward from the forearm such as at the upper arm, the opposite arm, a motor, a cable, or other arm actuation means. The distance between the forearm hinge to the elbow hinge is shorter, often much shorter, than to the end of the forearm.

Usually the relative lengths of the arm members is similar to the humans or animals they represent to provide a more realistic appearance and a more human-like hug. The mechanism in a toy provides a good feeling of being hugged when its arms are sized to reach around the user and a better hug when sized to reach from each side around the user's chest to his back. Arms reaching the user's back, when squeezed, pull the user toward the body and thereby allow a better hug.

Forearm

The forearm means comprises arm members outward from the upper arm including the forearm and the hand. Each forearm is resilient and has an inner arm portion between the forearm hinge and the elbow hinge and an outer arm portion extending outward from the forearm hinge to the outer end of the forearm. A relatively long forearm with the outer arm portion of the forearm longer than the inner arm portion provides a human-like feel, appearance, and facilitates human-like hugging. In the preferred embodiment, the length of the forearm is longer than the forearm actuator to allow the forearm to be able to extended behind a human user and, optionally, to support the hand and the hand actuator. Arm member dimensions can be changed, if applicable, to provide a creature-like hug. The forearm actuator and the hand actuator extend between the spaced separation of the vertical stabilizers or vertical arm portions of the upper arm and forearm, to reduce tooling costs such as moving slides and allow for two stage tooling for low cost plastic part manufacture.

The forearm's rigidly connected inner and outer arm portions allow it to operate like a lever with the fulcrum at the forearm hinge. In the preferred embodiment, the forearm hinge is supported inward a distance from the forearm axis to increase the forearm actuator leverage distance to the elbow hinge when the arm is extended substantially straight outward from the upper arm. The increased forearm actuator leverage results in greater forearm pressure on the user.

In the preferred embodiment, the elbow hinge is comprised of upper and lower portions which pivot only horizontally to increase arm stiffness in the vertical direction and improve the force applying capability of the arm. The elbow hinge is adapted to bend forwards and farther backwards than a human forearm to reduce the potential for breakage. Optionally, a separate elbow spring biases the forearm outward.

Hand actuator

Optionally, the hand is pivotally supported at the wrist on the outward end of forearm with the integral wrist spring to bias the hand outward. Optionally, each arm can also include the elongated, yielding hand actuator supported on the hand by the integral hand hinge and integral hand spring. On the inner end, optionally, the hand actuator is supported on the forward protruding forearm inner support by the integral hand actuator hinge and integral spring. The hand actuator spring, hand spring, and wrist spring co-act to bias the hand outward and forearm actuator forward and to return them to their original positions after the hand rotates inward and the pressure on the hand actuator is removed.

Forward rotation of the forearm into an object causes the yielding hand actuator to move toward the forearm and to partially match the contour of the hugged object. When the hand actuator is moved rearward, the hand, wrist, and hand actuator hinges flex and the hand pivots forward until it contacts a user or object or the hand actuator stop which prevents the hand actuator from bottoming on the forearm. The hand actuator contour reduces pressure points on the object hugged and increases the arm contact area for more user comfort and helps prevent the arm from slipping inward past the object hugged. With the hand actuator, the forearm makes contact from the tip of the hand to inner arm portion of the forearm inner support and provides the person receiving the hug the particularly gratifying hugging pressure from the side of the forearm. In certain cultures this type of hug normally shows more feeling by the person giving the hug and makes the receiver of the hug feel better.

Forearm actuator

In the preferred embodiment, the outer arm actuator, arm actuator or forearm actuator is supported from the body, first in a rearward direction and then in a forward direction outward to the forearm actuator hinge. This concave bend shortens the distance between the forearm actuator and the upper arm and allows for a more human-like shoulder appearance, especially when the arm is covered.

With each arm, when the hugging mechanism is squeezed and contacts an object, continued forward movement of the rear body pivots the upper arm outward thereby increasing its lateral extension forcing outward the forearm and extending the reach of the arm. Outward movement of the forearm straightens the curve of the forearm actuator and permits forearm to move outward. This construction provides the hugging mechanism the ability to increase arm encirclement of a user's body with the appearance of smaller arms in relation to the body and therefore look more human-like.

To partially comfortably conform and reduce the pressure points on the object or person being hugged, the forearm actuator is wide in comparison to a wire cable and yields along its length which allows the forearm actuator to be closer to the user's body for an improved hugging action. The forearm actuator also twists slightly vertically to compensate for the arcuate movement in the vertical axis of the front and rear arm supports about the bottom hinge and thereby allow a positive body attachment for both the forearm actuator and the upper arm.

With other embodiments, the outer arm actuator, forearm actuator or arm actuator can extend in front of and between the rear body member, the two arms, the two forearm or portions thereof either supported in front of or to the rear of the front body member such as shown in phantom in FIGS. 1 and 3.

Horizontal Hugging Movement

When the front body portion is placed against an object and hugged, the rear body portion and the upper arms move forward or sideways relative to each other which causes the upper arms to move forward or sideward relative to the forearm actuator. When the upper arm supported on the body at the upper arm hinge, a horizontal pivot of the arm hinge, moves forward, the forearm actuator rotates forward about the forearm actuator hinge. When the forearm actuator contacts the user and is no longer able to move forward, further forward movement of the upper arm causes the forearm actuator to rotate the forearm at the forearm hinge and together cause the forearm to pivot forward about elbow hinge to compensate for the upper arm being longer than the forearm actuator. The forearm actuator hinge and the upper arm hinge act as horizontal pivots of the arm hinge. The outer arm portion of the forearm inhibits the forearm from slipping inward along side of the object. More squeezing force applied to the body portions causes more hugging force delivered by the arm.

Different Simultaneous Arm Reach

In the preferred embodiment, the front and rear body portions, side stiffeners, the bottom hinge, and hinge supports elastically yield to vertically and horizontally twist and rotate with respect to each other to provide relative forward, backward, and sideways movement of the arm supports. When either the front or rear body portion is moved in a direction not parallel to the opposite body portion or directly forward or rearward, the front and rear arm supports for each arm, being connected to each other, move in same direction causing different angular movement of each arm. Thus, when the body portion or bottom or body hinge is twisted, each arm can reach and hug objects at different relative positions from the body at the same time.

Extended Reach

Increasing the arm reach of the hugging mechanism can be accomplished by a reach extending means having a motion transmissive means which moves to increase the lateral distance between arm supports of the two arms or two outer arm members and a reach actuating surface for applying inward pressure to actuate the arm support member. The front and rear body portions are each comprised of left body portions and right body portions connected together at their center in convex angular relation. The top stiffeners, with reduced width at their centers, allow limited inward bending. Increasing arm reach and substantially maintaining arm rotation can be accomplished by bending inward the convex curved front and rear body portions. Flexing the center hinge allows the left and right arm support of a body portion to move relative to each other. A motion transmissive means including a resilient arm support member or a fluid contained in an expandable and/or retractable enclosure, such as in a hydraulic or pneumatic system, is adapted to move one portion or member in a predetermined manner when a second portion or member is moved. A sufficient inward force orthogonal to the lateral direction, causes the left and right body portions to deflect horizontally inward and increase the horizontal or lateral distance between the arm supports thus increasing the arm reach and also cause the arms to move in a hugging action.

If the left and right side stiffeners contact each other when the front and rear body portions are squeezed together, further inward body movement spreads the arm supports apart laterally and increased arm reach. Different hugging actions can be effected by constructing different rear body portion depths and different side stiffener dimensions.

In the preferred embodiment, relative movement between arm supports for the front body portion is not as great as for the rear body portion because increasing the distance between the front arm supports reduces arm rotation and therefore the ability to hug as wide size range of people and objects.

Inner then Outer Arm Movement

In the preferred embodiment each arm has an arm control means to cause the inner arm member to move before the outer arm member pivots. In one embodiment of the arm control means, integral springs in forearm hinge and the elbow hinge which, in combination, comprise a pivoting resistance member having greater resistance to bending than the spring in the forearm actuator hinge and the yielding resistance of the forearm actuator. When the forward angled upper arm moves forward, it pivots the outer end of the inner arm or forearm actuator forward in front of the body of the mechanism. The spring integral to the forearm actuator and the elbow spring together as a forearm spring and inhibit the forearm from pivoting forward about the elbow hinge until after the forearm actuator hinge bends and forearm actuator pivots forward. If sufficient rearward force stops forward movement of the forearm actuator, further movement of the upper arm causes the forearm to pivot forward. The sequence of motion of first the inner arm and second the pivoting of the outer arm allows the side of the arm rather the tip to touch the user first and provides a more human-like hug. Also, the forearm and elbow springs act to bias the forearm outward to increase the arm's ability to hug a large sized object.

Vertical Arm Movement

For vertical movement of each arm, a forearm actuator pivot pin connects the forearm actuator to the front arm support and upper arm pivot pin, as the vertical portion of the arm hinge, connects the upper arm to the rear arm support. When moved by the user or by contacting a surface, the forearm actuator and the upper arm can pivot together to allow vertical up or down arm movement. When the arms are in a down position, moving together of the front and rear arm supports also moves the arm vertically upward. The hugging mechanism can hug upward when the arms down and hug downward the arm up from horizontal. The vertical movement allows the arms to better adapt to the contour of a user or object being hugged, avoid their arms, and thus have a more realistic hugging action. Vertical arm movement can reduce the vertical stress in an arm member which could otherwise damage the arm and also allows for lowering the arms for storage or display.

The arm supports positioned between the arm and the body are adapted to hold each arm in a plurality of positions including a stable down and a stable horizontal position. Vertical arm movement from a horizontal position, causes the shoulder spring to bend and for limited displacements, causes the arm, when released, to return to a stable horizontal position. Alternately, the shoulder spring can be supported by other body and arm members including the front and rear arm supports, the forearm actuator, and the upper arm. Alternately, a plurality of stable vertical arm positions can be provided by surface friction, bosses, magnets, or other locating means between arm and body members. A stable down arm position is often used when the doll is not being used.

In the preferred embodiment, when an arm is in a stable down position, the forearm actuator is twisted upward at the forearm hinge at slightly greater angle upward than the upper arm axis. This construction helps the hugging mechanism, when the front and rear arm supports move toward each other, to pull the arm upward. When the arm moves a sufficient upward distance, the shoulder spring forces the arm to move further upwards to a stable horizontal position before the forearm moves substantially inward. Thus, a doll with its arms in a stable down position, when hugged, will have both arms pop upward and appear to come alive.

A toy using the present invention, because the arms are adapted to move vertically, can be packaged, stored, or displayed with the arms stored in either downward or forward position. Compared to a doll with only horizontally moving arms, a doll with arms able to move vertically can put more easily in a smaller package, stored in a smaller volume, or displayed with less shelf space for reduced inventory, packaging displaying, and shipping costs.

Motorized Hugging Mechanism

An alternative means to power a hugging action comprises a motor means including a motor, a power source and a sensor means such as a pressure sensor which are connected together in operational relation to actuate the arms in a hugging motion. The sensor means is adapted to react to pressure such as by a human hugging the mechanism or by other stimuli and activate the motor means which is supported on one body portion. The motor pulls inward a cable which pulls together the front and rear body portions and, optionally, pivots forward the forearms. As an example of one cable routing, the sensor activates the motor on a body portion which pulls a cable to move inward the opposite body portion and cause the arms to hug. In an alternative cable routing, the flexible cable extends from one forearm, though cable guides on the upper arm and rear body portion, through a cable balance, and through similar cable guides to the opposite forearm. The motor pulls the center cable inward while the center balance guide allows the cable in one arms to move to the opposite arm to adjust, as necessary, to different arm forces. The motor can pull the center cable inward with one arm prevented from moving.

An alternative means for balancing the force on the right and left arms is by a balance spring means which can be included with the motor means.

The drawings show non-exclusive examples the some of the possible locations of the cable guides, motor means, power source, sensor means, and cable supports which can be supported on any member of the hugging mechanism that allows the motor means, when activated, to pull together the front and rear body portions and cause the arms to move in a hugging motion.

Usage and Integration

The hugging mechanism is designed to be used as a means to move arms to contact and, if needed, to apply pressure on objects or people. As a consequence, the mechanism has the ability to hold and manipulate objects, provide entertainment, affect feelings in a user or observer, and other such objects that fall within the scope of this invention. Further, the present invention is designed to be used with toys including androids, especially dolls, animals, and human-like creatures.

A doll structure (not shown) may require modifications such as a flexible outer body covering with padding in appropriate body areas, a large chest, large shoulders, or an opening in the doll for insertion of the hugging mechanism into the doll. A flexible covering over the mechanism but inside the doll can be used to prevent stuffing from getting into the mechanism.

With respect to the above description then, the optimum dimensional relationships for the parts of the invention, to include variations in shape, size, materials, form, function, and manner of operation, assembly and use, are deemed obvious to one skilled in the art, and all equivalent relationships to those illustrated in the drawings or described in the specification are intended to be encompassed by the present invention.

The foregoing is considered as illustrative only of the principles of the invention. Further, since changes will occur to those skilled in the art, the invention is not limited to the exact construction and operation shown and described, and accordingly, all suitable modifications and equivalents fall within the scope of the invention.

I claim:

1. A hugging mechanism comprising, a rear body member and a front body member supported, in articulated relation and a distance in front of and on the rear body member, the rear body member supporting, in articulated relation, two arms, each arm comprising an inner arm member supported, in articulated relation on the rear body member, and an outer arm member supported, in articulated relation, on the outer end of the inner arm member, and an arm actuator supported on a first end, in articulated relation, on the outer arm member an offset distance from the inner arm member, and on a second end, on the front body member a distance in front the rear body member, for each arm the combined lengths of the inner arm member and the outer arm member inward from the attachment of the arm actuator it supports is greater than the length of the arm actuator between the outer arm member and the front body member, the arm actuator is adapted to provide a hugging arm motion by rotating the arms forward on the rear body member when the front body member is moved toward the rear body member.

2. The mechanism of claim 1 further including for each arm, a flexible wrist spring supported on the outer end of the outer arm member, and a hand, supported, in articulated relation, on the wrist spring, the wrist spring adapted to move the hand forward towards a predetermined position and to provide a predetermined resisting force when the hand is moved from the predetermined forward position.

3. The mechanism of claim 1 further including for each arm, a hand supported, in hinged relation, on the outer end of the outer arm member, and a resilient hand actuator supported on the hand and extending a distance in front of the outer arm member, the hand actuator adapted to pivot the hand forward when the hand actuator is moved toward the outer arm member.

4. The mechanism of claim 1 further including for each arm, an arm hinge supporting the inner arm member on the rear body member, the arm hinge adapted to allow the arm to move in articulated relation to the rear body in both the horizontal axis and the vertical axis.

5. The mechanism of claim 1 further including for each arm, an arm controlling means having an elbow spring supported between the inner arm member and the outer arm member, the elbow spring is adapted to provide the outer arm member a greater resistance to rotation on the inner arm member than the inner arm member has resistance to rotation on the body, and the elbow spring is adapted to allow the inner arm member to rotate on the rear body before the outer arm member rotates on the inner arm member when the front body member moves toward the rear body member.

6. The hugging mechanism of claim 1 further comprising, a power source, a motive means comprising, a motor operationally connected to the power source, a resilient cable supported by front body member and extending to and supported by the rear body member, a pressure sensor connected in operational relation thereto and, when pressed, adapted to activate the motor means, the motive means, when activated, adapted to pull the cable and the attached body members toward each other and cause the arms to move in a hugging motion.

7. The arm of claim 1 wherein the hugging mechanism includes a toy.

8. A hugging mechanism having a body, the body comprising a rear body and a front body supported, in articulated relation, a distance in front of and on the rear body, and two arms, each arm comprising, an inner arm member supported in articulated relation on the body, and an outer arm member supported in articulated relation on the outer end of the inner arm member, and an outer arm actuator supported, on one end, in articulated relation, on the outer arm member an offset distance from the inner arm member and supported, on a second end, on the front body, an arm controlling means for each arm supported between the body and the outer arm member to provide a predetermined resistance to rotation of the outer arm member on the inner arm member which is greater than the resistance to rotation of the inner arm member on the body, the inner arm member is adapted to rotate forward on the body before the outer arm member rotates on the inner arm member to provide a hugging motion when the front body moves toward the rear body.

9. The mechanism of claim 8 wherein the arm controlling means is an elbow hinge spring supported between the inner arm member and the outer arm member, the elbow hinge spring is adapted to provide a predetermined resistance to rotation of the outer arm member about the inner arm member.

10. The mechanism of claim 8 wherein the hugging mechanism includes a toy.

11. A hugging mechanism in combination with a toy comprising a body, the body comprising a rear body and a front body supported in articulated relation on the front body, a portion of the front body is supported a distance from the rear body, two arm hinges supported on the rear body, two arms, each arm supported on one of the arm hinges, each arm hinge adapted to allow its supported arm to articulate in both the vertical axis and horizontal axis with respect to the rear body, for each arm an arm actuator supported on a first end, in articulated relation, on the arm and on a second end, in articulated relation, on the front body, the arms adapted to move in a hugging motion when a portion of the front body is moved toward the rear body.

12. The hugging mechanism of claim 11 further including, for each arm, a vertical arm support, said arm support comprising a protrusion between the arm and the body and supported on the rear body and adapted to support the arm in a substantially horizontal position and to allow the arm to be moved vertically.

13. The hugging mechanism of claim 11 further including, for each arm, an arm support spring supported on a first end on the rear body member and on a second end on the arm and adapted to contact the rear body, the arm support spring adapted to rotate the arm to a predetermined vertical position.

14. The hugging mechanism of claim 11 further including, for each arm, an arm stop supported on the body, the arm stop adapted to engage and support the arm in a plurality of vertical positions relative to the body.

15. A hugging mechanism comprising a body and arms, the body comprising a rear body, and a front body supported, in articulated relation, by the rear body a spaced distance in front of the rear body, two arms extending outwardly from the rear body member, for each arm an arm actuator supported at its outer end, in articulated relation, on the arm and supported on its inner end, in articulated relation, on the front body, each arm actuator having a length shorter than the length of each arm from the outer arm actuator to the rear body, each arm is adapted to move forward in a hugging motion when the front body is moved toward the rear body.

16. The hugging mechanism of claim 15 wherein each arm further comprises, an inner arm supported, in articulated relation, on the rear body, and an outer arm supported, in articulated relation, on its outer end on the inner arm, and the arm actuator is supported at its outer end, in articulated relation, on the outer arm an offset distance from the inner arm and supported, in articulated relation, on its inner end on the front body, the combined shortest distance between the outer ends of the arm actuators along the arm actuators of the two arms and the front body is less than the shortest distance between the outer ends of the outer arm actuators along the each inner arm and rear body, the arms are adapted to move forward in a hugging motion when the front body is moved toward the rear body.

17. The hugging mechanism of claim 16 wherein for each arm, the arm actuator has a length shorter than the corresponding portion of the arm from the rear body to the arm actuator such that moving the arm actuator towards the arm causes the arm to bend at the junction of the inner and the outer arm.

18. The hugging mechanism of claim 15 wherein the body is flexible and is adapted to allow each arm, at its support location on the rear body, to rotate horizontally relative to each other and is adapted to allow each arm to be supported by the arm actuator and the rear body member simultaneously in different orientations and allow each arm to be in different orientations relative to the body at the same time.

19. The hugging mechanism of claim 15 wherein a body hinge supports the front body on the rear body in multiple axis rotational relation and is adapted to allow each arm to be in a different orientation with respect to the body at the same time.

20. A hugging mechanism comprising, a rear body, and two arms extending outwardly from the rear body, each arm comprising, an upper arm supported, in articulated relation, on the rear body, a forearm supported in articulated relation on the outer end of the upper arm, and a forearm actuator supported on its outer end, in articulated relation, on the forearm a distance from the upper arm, extends a distance in front of the rear body, and is supported on its inner end, in articulated relation, on the forearm actuator of the opposite arm of the hugging mechanism, the lengths of the forearm actuators between their forearm supports on each arm is less than the combined lengths of the arms inward from each of their forearm actuator supports and the length between the arm supports on the rear body, the forearm actuator is adapted to move the arms forward in a hugging motion when it is moved toward the rear body.

21. The hugging mechanism of claim 20 further including a toy.

22. The hugging mechanism of claim 20 further including a front body positioned in front of the rear body and supported in articulated relation on the rear body.

23. A hugging mechanism for a toy comprising, a body, the body comprising a front body and a rear body supported a spaced distance from the front body, two arm supports, each arm support supported on the body, two arms, each arm supported in articulated relation to the body by an arm support, each arm support adapted to allow the arm to articulate in both the horizontal axis and the vertical axis, two arm actuators, each arm actuator supported on a first end, in articulated relation, on the front body and on a second end, in articulated relation, on the arms, the arms adapted to move towards each other in a hugging motion when the front body and the rear body are moved together, further including for each arm an arm support spring supported on a first end on the body and on a second end on the arm, the arm support spring adapted to vertically rotate the arm on the arm support to a predetermined vertical position, and further including, for each arm, an arm stop supported on the body, the arm stop is adapted to engage and support the arm rotated to a downward position to allow the arm to rotate directly to a substantially horizontal position when the arm is released from the stop.

24. The hugging mechanism of claim 23 further including an arm stop supported on the body, the arm stop is adapted to engage and support the arm in multiple vertical positions.

25. A toy hugging mechanism comprising, a body, two arm supports supported by the body, two arms located a horizontal distance apart, each arm is supported, in articulated relation, by an arm support, the body comprises an articulating offset portion located between the two arms supports and a distance offset from a projected horizontal line between where the arms are supported on the body, the body including a vertically oriented body hinge, the body hinge extends vertically and separates the body into a right portion and a left portion, arm supports are located on the right portion and the left portion, the body is adapted to push apart and increase the horizontal distance between the arm supports via the body hinge when the body is squeezed from the front and from the rear.

26. The body of claim 25 wherein the body comprises, a rear body and a front body, the offset portion is supported on the rear of the body and is adapted to move the arms supports horizontally away from each other when the offset portion moves toward the front body.

27. A body in combination with a toy hugging mechanism comprising, a front body, a rear body, and a body hinge supported between the front body and the rear body, the body hinge adapted to bend in two axes to allow relative movement between the front body and the rear body in the horizontal, vertical and rotational axes further comprising two arms, each arm comprising an upper arm supported, in articulated relation, on the body, a forearm supported, in articulated relation, on the outer end of the upper arm, a forearm actuator supported on one end, in articulated relation, on the forearm a distance from the upper arm and on a second end, in articulated relation, on the body a distance from the support of the upper arm, the rear body portion is adapted to twist allowing the distance between the upper arm support on the body and the forearm actuator support on the body to be different distances for each arm and allow the arm to move foreword different distances at the same time.

28. The body of claim 27 wherein the body hinge supports the front body a distance from the rear body, the body hinge comprising multiple hinges supported a distance horizontally apart from each other to allow the front body and the rear body to twist relative to each other.

29. The body of claim 27 wherein the body hinge comprises, a right hinge and a left hinge supported a spaced distance from the right hinge, the body hinge adapted to allow the right and left hinge fit a distance into two legs of a toy.

30. The body of claim 29 further including a toy.

* * * * *